US006550162B2

(12) United States Patent
Price et al.

(10) Patent No.: US 6,550,162 B2
(45) Date of Patent: Apr. 22, 2003

(54) SEDIMENT REMOVAL SYSTEM

(76) Inventors: Robert E. Price, 1859 Laraway Lk. Dr. SE., Grand Rapids, MI (US) 49546; Eugene A. Christenson, 1859 Plainfield Ave. NE., Grand Rapids, MI (US) 49505

( * ) Notice: Subject to any disclaimer, the term of this patent is extended or adjusted under 35 U.S.C. 154(b) by 0 days.

(21) Appl. No.: 09/815,839

(22) Filed: Mar. 23, 2001

(65) Prior Publication Data

US 2002/0133982 A1 Sep. 26, 2002

Related U.S. Application Data

(60) Provisional application No. 60/191,520, filed on Mar. 23, 2000.

(51) Int. Cl.[7] ..... E02F 3/92
(52) U.S. Cl. ..... 37/317
(58) Field of Search ..... 37/307, 313, 314, 37/317, 320, 321–326, 342–345, 248–257; 15/1.7, 3, 117, 296, 66, 77; 299/39, 64, 65

(56) References Cited

U.S. PATENT DOCUMENTS

| | | | |
|---|---|---|---|
| 116,282 | A | 6/1871 | Ebbert |
| 692,815 | A | 2/1902 | Bates |
| 715,408 | A | 12/1902 | Murray |
| 1,482,698 | A | 2/1924 | Peterson |
| 2,131,002 | A | 9/1938 | Streander |
| 2,646,889 | A | 7/1953 | Dulak |
| 2,902,705 | A | 9/1959 | Eistrup |
| 2,923,954 | A | 2/1960 | Babcock |

(List continued on next page.)

FOREIGN PATENT DOCUMENTS

| | | |
|---|---|---|
| DE | 939593 | 2/1956 |
| FR | 997304 | 1/1952 |
| FR | 2693499 | 1/1994 |
| JP | 5249658 | 4/1977 |
| JP | 59220536 A | 12/1984 |
| JP | 6055132 | 3/1985 |
| JP | 4128422 | 4/1992 |
| JP | 4312626 | 11/1992 |
| NL | 8403722 | 7/1986 |
| SR | 125763 | 1/1957 |

*Primary Examiner*—Robert E. Pezzuto
(74) *Attorney, Agent, or Firm*—Price, Heneveld, Cooper, DeWitt & Litton

(57) ABSTRACT

A sediment removal system includes a vessel adapted to float on the surface of a body of water, and a crawler adapted to be submerged in the body of water, wherein the crawler includes a drive system for moving the crawler across a bottom of the body of water, and wherein the crawler includes a suctioning device that supplies a suctioning force that is utilized to remove sediments resting on the bottom of the body of water. The sediment removal system also includes a sediment removal line in communication with the suctioning device and adapted to carry the sediment from the suctioning device away from the crawler. The sediment removal system further includes at least one supporting line extending downwardly from the barge to the submerged apparatus thereby tethering the submerged apparatus to the barge, and at least one tensioning device in mechanical communication with the support line, wherein the tensioning device maintains a tensioning force in the support line at all times, thereby removing any slack within the support line between the vessel and the crawler and requiring the vessel to track substantially close on the surface of the water with the crawler as the crawler tracks along the bottom of the body of water.

24 Claims, 7 Drawing Sheets

U.S. PATENT DOCUMENTS

| | | | | | |
|---|---|---|---|---|---|
| 2,988,762 | A | | 6/1961 | Babcock | |
| 3,160,966 | A | | 12/1964 | Skakel | |
| 3,229,315 | A | | 1/1966 | Watson | |
| 3,248,812 | A | | 5/1966 | Gardner, Jr. | |
| 3,314,174 | A | | 4/1967 | Haggard | |
| 3,412,862 | A | | 11/1968 | Chaplin | |
| 3,540,194 | A | | 11/1970 | Chaplin | |
| 3,568,454 | A | | 3/1971 | Itami | |
| 3,629,963 | A | | 12/1971 | Itami | |
| 3,659,712 | A | | 5/1972 | Chaplin | |
| 3,706,142 | A | | 12/1972 | Brunner | |
| 3,753,265 | A | | 8/1973 | Wulc | |
| 3,860,518 | A | | 1/1975 | Henricksen | |
| 3,868,739 | A | | 3/1975 | Hargrave | |
| 3,905,137 | A | | 9/1975 | Gee | |
| 3,919,790 | A | | 11/1975 | Sasaki et al. | |
| 3,971,593 | A | | 7/1976 | Porte et al. | |
| 3,972,339 | A | | 8/1976 | Henkin et al. | |
| 3,979,788 | A | | 9/1976 | Strausak | |
| 4,053,181 | A | | 10/1977 | Saito | |
| 4,152,800 | A | | 5/1979 | Nilsmar | |
| 4,154,680 | A | | 5/1979 | Sommer | |
| 4,311,342 | A | | 1/1982 | Latimer | |
| 4,357,764 | A | | 11/1982 | Lemercier et al. | |
| 4,434,519 | A | | 3/1984 | Raubenheimer | |
| 4,480,569 | A | | 11/1984 | van der Veen et al. | |
| 4,503,629 | A | | 3/1985 | Uchida | |
| 4,581,075 | A | | 4/1986 | St. Martin | |
| 4,615,802 | A | | 10/1986 | Harbaugh | |
| 4,642,919 | A | | 2/1987 | Werner et al. | |
| 4,651,376 | A | | 3/1987 | Ford | |
| 4,658,751 | A | | 4/1987 | Koot | |
| 4,685,742 | A | * | 8/1987 | Moreau | 299/8 |
| 4,750,279 | A | | 6/1988 | Hofland | |
| 4,808,305 | A | | 2/1989 | Arnold | |
| 4,849,024 | A | | 7/1989 | Supra | |
| 4,887,371 | A | * | 12/1989 | Kaiser | 37/66 |
| 4,920,599 | A | | 5/1990 | Rief | |
| 4,957,622 | A | | 9/1990 | Mims | |
| 5,099,535 | A | | 3/1992 | Chauvier et al. | |
| 5,203,099 | A | | 4/1993 | Naranjo et al. | |
| 5,205,174 | A | | 4/1993 | Silverman et al. | |
| 5,245,723 | A | | 9/1993 | Sommer | |
| 5,279,012 | A | | 1/1994 | Sloan | |
| 5,337,434 | A | | 8/1994 | Erlich | |
| 5,351,355 | A | | 10/1994 | Chiniara | |
| 5,412,826 | A | | 5/1995 | Raubenheimer | |
| 5,507,058 | A | | 4/1996 | Minami et al. | |
| 5,513,930 | A | | 5/1996 | Eathorne | |
| 5,542,141 | A | | 8/1996 | Albright | |
| 6,017,400 | A | | 1/2000 | Clark et al. | |

* cited by examiner

SEDIMENT REMOVAL SYSTEM

CROSS-REFERENCE TO RELATED APPLICATION

This application claims the benefit of U.S. Provisional Application No. 60/191,520, filed Mar. 23, 2000, entitled SEDIMENT REMOVAL SYSTEM.

BACKGROUND OF THE INVENTION

The present invention relates to systems for removing sediments from bodies of water, and in particular to a system for removing sediments from the bottoms or beds of holding or settling ponds as used in wastewater treatment.

Numerous systems are used to remove sediment buildup from settling ponds used in conjunction with the treatment of wastewater such as sewage water. Some of these systems include an apparatus which is located below the waterline and near the bottom of the settling pond and which is coupled to a suction providing device located on the shore or within a boat floating over the apparatus located on the bottom of the settling pond.

Heretofore, the pumps associated with collecting the sediment from the bottom of the settling ponds have been located on the shore or within a vehicle located nearby the underwater apparatus. The pump is coupled with an aperture associated with the underwater apparatus by a plurality of piping and/or tubing. The aperture is positioned so as to allow the removal of sediment therethrough. In operation, the pump, located on the vehicle located above the waterline or on the shoreline, delivers a vacuum pressure to the piping and/or hosing which in turn deliveries a vacuum pressure to the aperture associated with the underwater apparatus. The waste sediment is removed from the bottom of the pond and delivered through the hosing and/or piping of the pump, and then delivered from the pump to a suitable storage tank. These systems typically exhibit a significant loss in head pressure (or suction power) as a result of the pump being connected to the underwater apparatus by extensive lengths of piping and hosing. This reduced pumping pressure decreases the effectiveness of the removal of the sediment as well as limits the speed at which the sediment can be removed. This limitation is magnified as the depth of the body of water increases as the length of the piping and hosing connected to the pump with associated underwater apparatus must also necessarily increase.

Other problems associated with current sediment removal systems include the lack of precision control an operator has over the underwater apparatus, as well as the lack of control the operator has over flow rates. The amount of water removed from the pond should be kept at a minimum to reduce waste handle and storage costs. By allowing the operator to control flow rates and intake characteristics, the amount of water removed with the sediment could be minimized.

A sediment removal system providing high pumping pressure at the removal apparatus, highly precise maneuverability and navigation, and control of pumping rates and characteristics would be very beneficial to the sediment removal industry.

DETAILED DESCRIPTION OF PREFERRED EMBODIMENT

Figure 1:
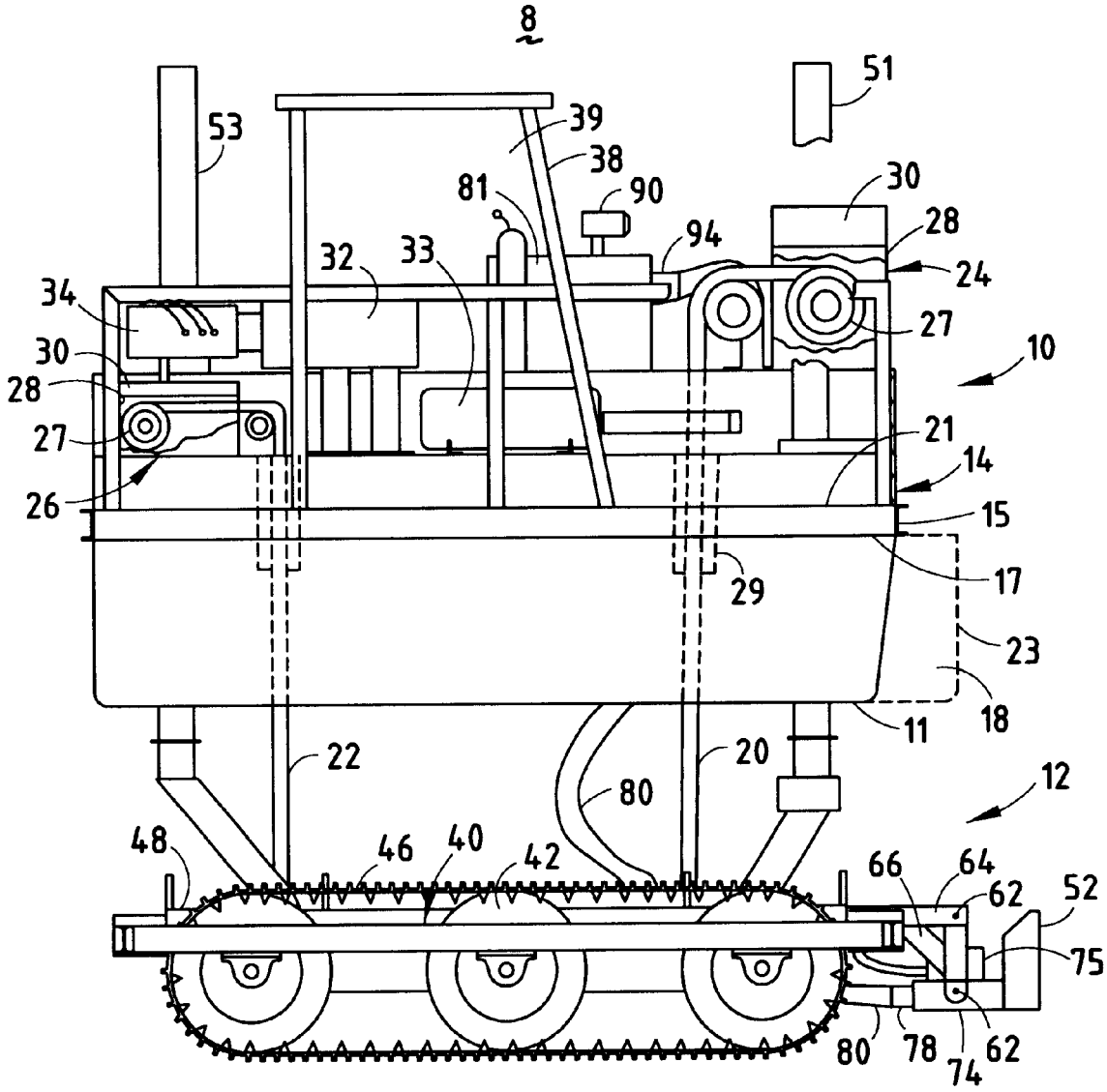
FIG. 1 is a side elevational view of a sediment removal system, embodying the present invention, with a portion of the sediment removal system broken away to reveal internal construction.
Figure 2:
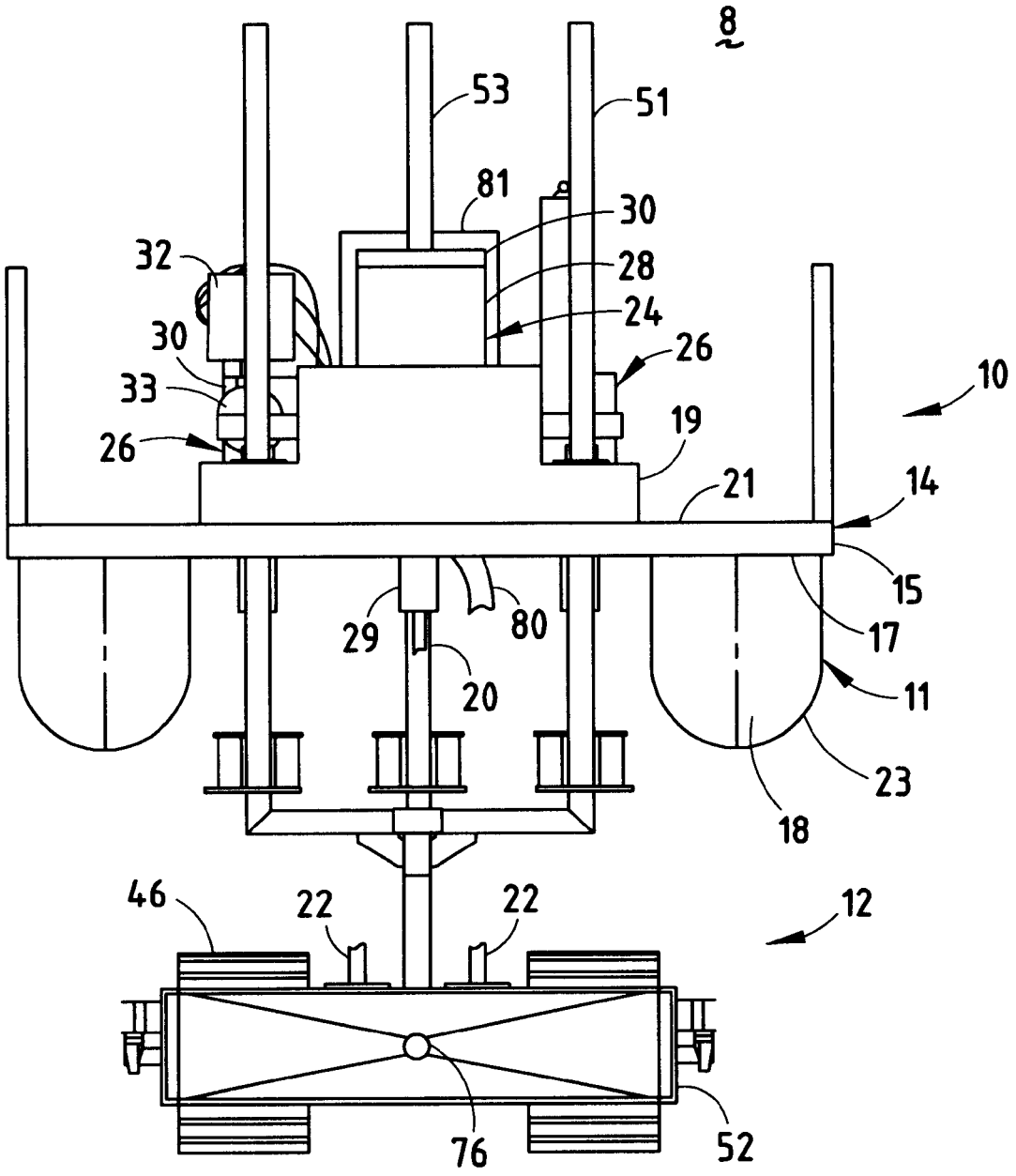
FIG. 2 is a front elevational view of the sediment removal system.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings and described in the following specification are exemplary embodiments of the inventive concepts defined herein. Hence, specific dimensions and other physical characteristics relating to the embodiments disclosed herein are not to be considered as limiting.

The present inventive sediment removal system 8 includes a barge 10 (FIGS. 1 and 2) adapted to float upon the surface of a body of water and a crawler apparatus 12 adapted to track along the bottom or bed of a body of water and which is hydraulically and mechanically linked to barge 10.

Figure 3:
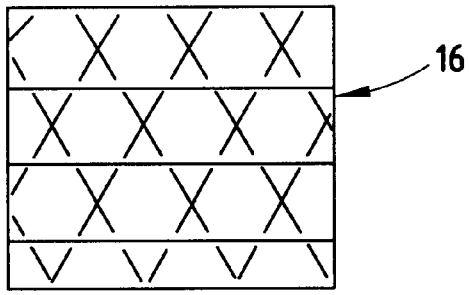
FIG. 3 is a cross-sectional view of a honeycomb section of a barge of the sediment removal system.
Figure 4:
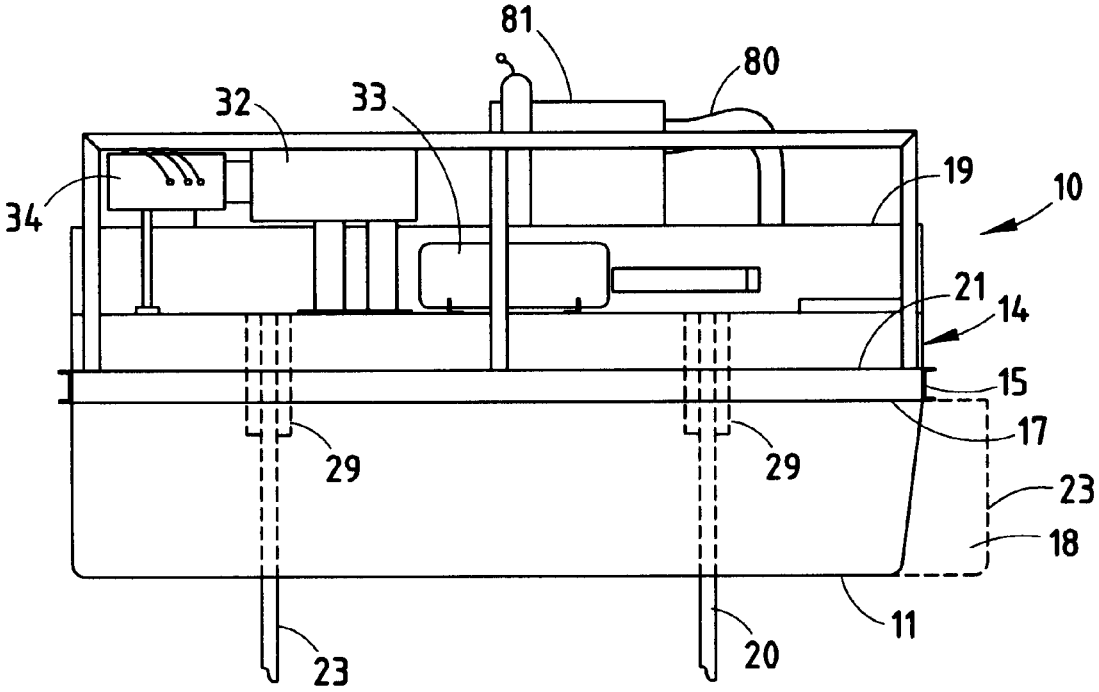
FIG. 4 is a side elevational view of the barge.
Figure 5:
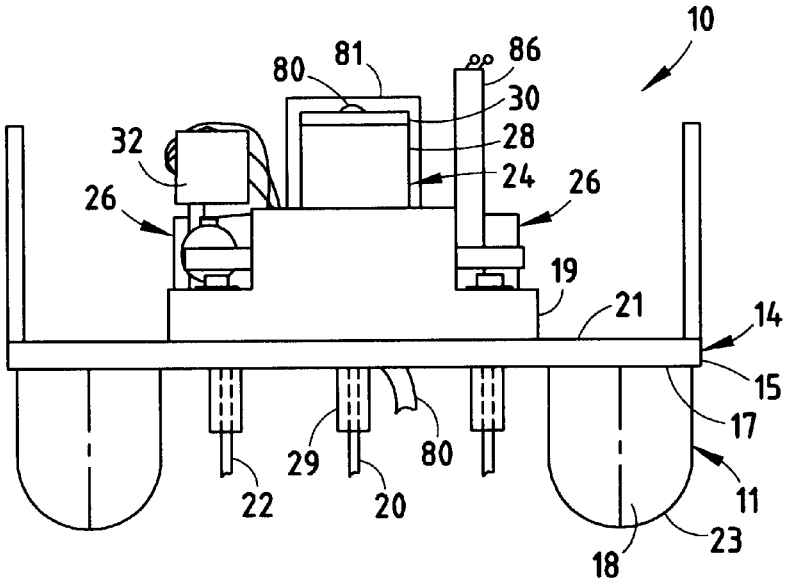
FIG. 5 is a front elevational view of the barge.

Barge 10 (FIGS. 1, 2 and 4–6) includes a vessel 14 that includes a deck 15 supported by a pair of longitudinally extending pontoon-type floats 11 fixedly attached to a bottom surface 17 of deck 15, and a body 19 supported on a top surface 21 of deck 15, constructed of stainless steel, aluminum, and/or other non-corrosive material suitable for such application. The floats 11 are spaced a significant distance apart, thereby increasing the stability of vessel 14 when in operation. Floats 11 and body 19 of vessel 14 are each reinforced with a honeycomb-type structure, generally designated by numeral 16 (FIG. 3). The honeycomb-type structure provides reinforcement to the components of barge 10, thereby increasing the structural rigidity thereof. Although a honeycomb-type structure is preferred for constructing floats 11 and body 19, other materials capable of providing sufficient structural rigidity may be utilized. The forward section or bow 23 of vessel 14 is provided with a slight rake 18. Rake 18 provides stability to barge 10 when used within bodies of water that have a current, such as streams or rivers. Barge 10 also includes an operator's canopy 38 that defines an operating compartment 39 and which protects an operator from the elements.

A plurality of hydraulic lines, including a forward hydraulic line or hose 20 and rearward hydraulic lines or hoses 22 are operably attached to barge 10, extend downwardly therefrom, and are fixedly attached to crawler 12. More specifically, hydraulic lines 20 and 22 are operably attached to a forward hoist system 24 and a rear hoist systems 26, respectively. Forward hoist 24 and rear hoist systems 26 each include a spindle 27 about which hydraulic lines 20 and 22 coil. In operation, hydraulic lines 20 and 22 are used to support crawler 12 during the raising and lowering thereof. It should be noted that greater than the three illustrated hydraulic lines 20 and 22 may be used to link crawler 12 with barge 10. Each hoist system 24 and 26 includes a pressure clutch and/or a pressure switch that controls the rotation of spindles 27 and ensures that hydraulic lines 20 and 22 are kept taunt during operation.

Forward hoist system 24 and rear hoist systems 26 each include a sealed outer housing 28. A rinse unit 30 is attached to each housing 28 and includes a water pumping system capable of rinsing hydraulic lines 20 and 22 from debris collected from the body of water from which the sediment is being removed while hydraulic lines 20 and 22 are downwardly extended. Each hydraulic line 20 and 22 is surrounded by a hose guide 29 that ensures alignment of hydraulic lines 20 and 22, and protects hydraulic lines 20 and 22 from damage when exposed.

A power unit 32 such as a diesel engine is situated within barge 10 and provides power for numerous operations as discussed below. Power unit 32 receives fuel from a fuel tank 33. Power unit 32 is mechanically linked to a hydraulic pump 34, which receives hydraulic fluid from a hydraulic tank 83. A plurality of pipes (not shown) provide hydraulic communication between hydraulic pump 34 and the hydraulic lines 20 and 22, that extend downwardly from barge 10. Hydraulic lines 20 and 22 are in hydraulic communication with several components of crawler 12, as discussed below.

Figure 6:
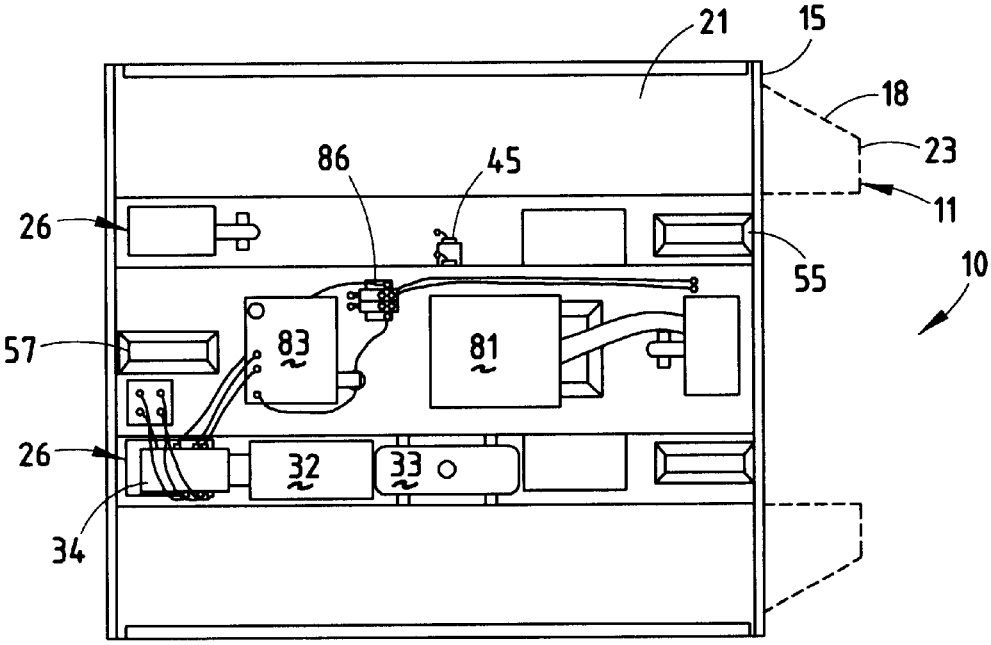
FIG. 6 is a top plan view of the barge.
Figure 7:
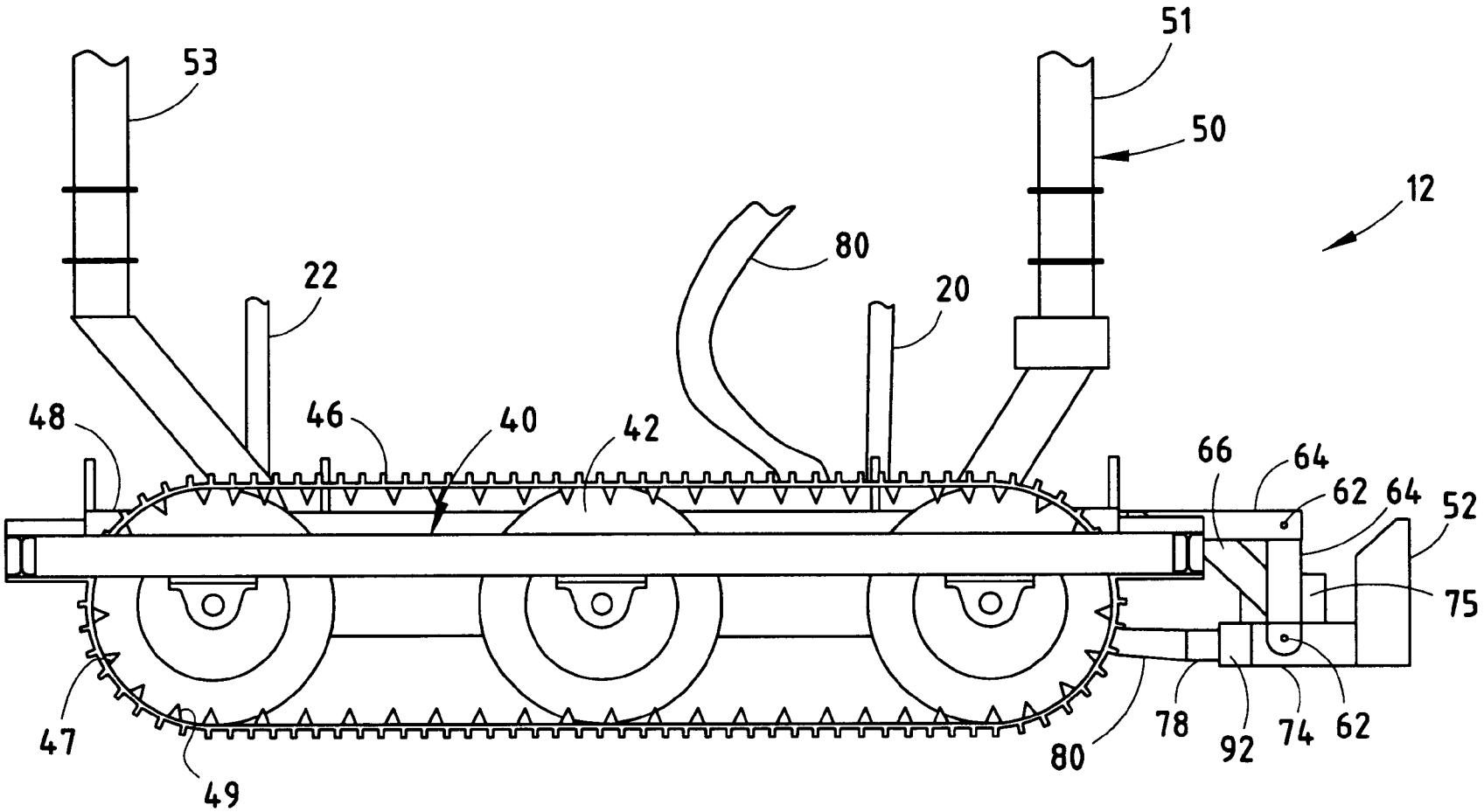
FIG. 7 is a side elevational view of a crawler of the sediment removal system.
Figure 8:
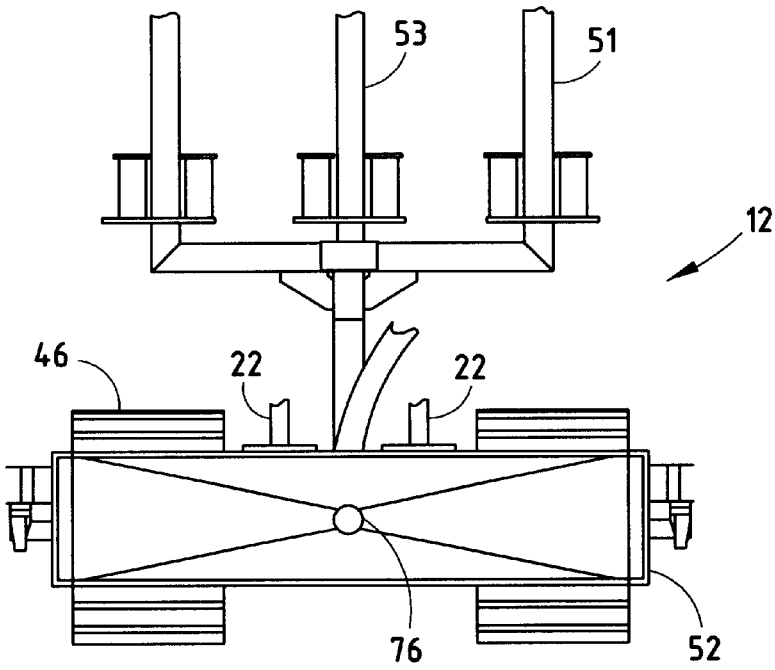
FIG. 8 is a front elevational view of the crawler.
Figure 9:
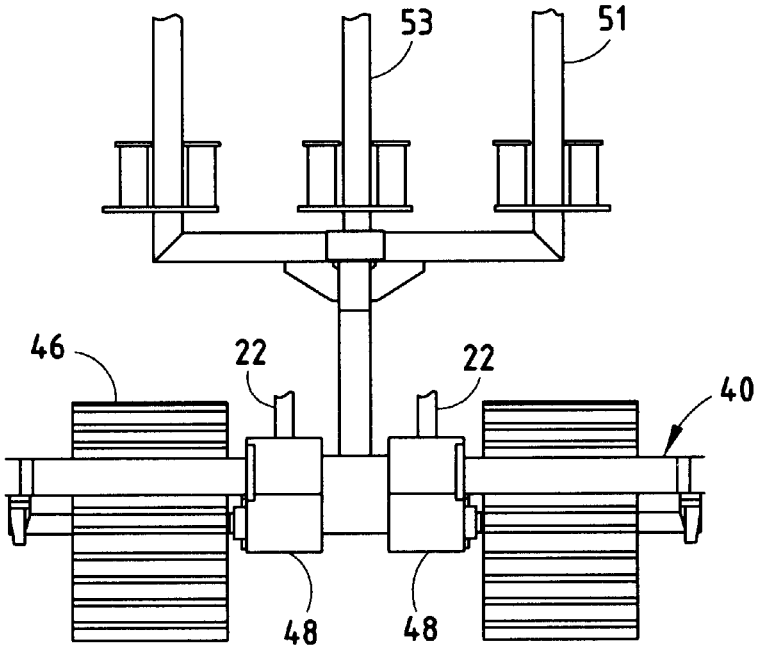
FIG. 9 is a rear elevational view of the crawler.

The crawler 12 (FIGS. 1, 2 and 7–9) includes a frame 40 that rotatably supports three sets of wheels 42 that extend along each side of frame 40. The frame is constructed of a non-corrosive metal or other material suitable for such use. Wheels 42 are located on each side of crawler 12 and are positioned so as to support a pair of track members 46 that extend along each side of crawler 12. Wheels 42 include a plurality of notches 47 that are positively engaged by a plurality of teeth 49 extending from an inner surface of each track member 46. Wheels 42, rollers 44 and track members 46 are each constructed of a rubber material suitable for underwater applications. A pair of hydraulics drive motors 48 are mechanically coupled with track members 46. Drive motors 48 are capable of motivating track members 46 in opposite directions of rotation, thereby allowing the crawler 12 to be "pivoted" and tightly maneuvered. Drive motors 48 are controlled by the operator via a controller 45 (FIG. 6).

Crawler 12 also includes a docking stand 50 attached atop frame 40 and adapted to allow docking of barge 10 onto crawler 12 when barge 10 and crawler 12 are withdrawn from the associated body of water. Docking stand 50 includes a plurality of docking legs including a pair of forward docking legs 51 juxtaposed across frame 40 and a single rearward docking leg 53. The legs 51 and 53 are received within a pair of forward docking apertures 55 (FIG. 6) and a rearward docking aperture 57, respectively. This docking further allows barge 10 and crawler 12 to be maneuvered and manipulated as a single unit when on "dry land". It should be noted that apertures 55 and 57 are sized to allow crawler 12 to be "rocked" or tilted with respect to barge 10 even when legs 51 and 53 are engaged within apertures 55 and 57, respectively.

Figure 10:
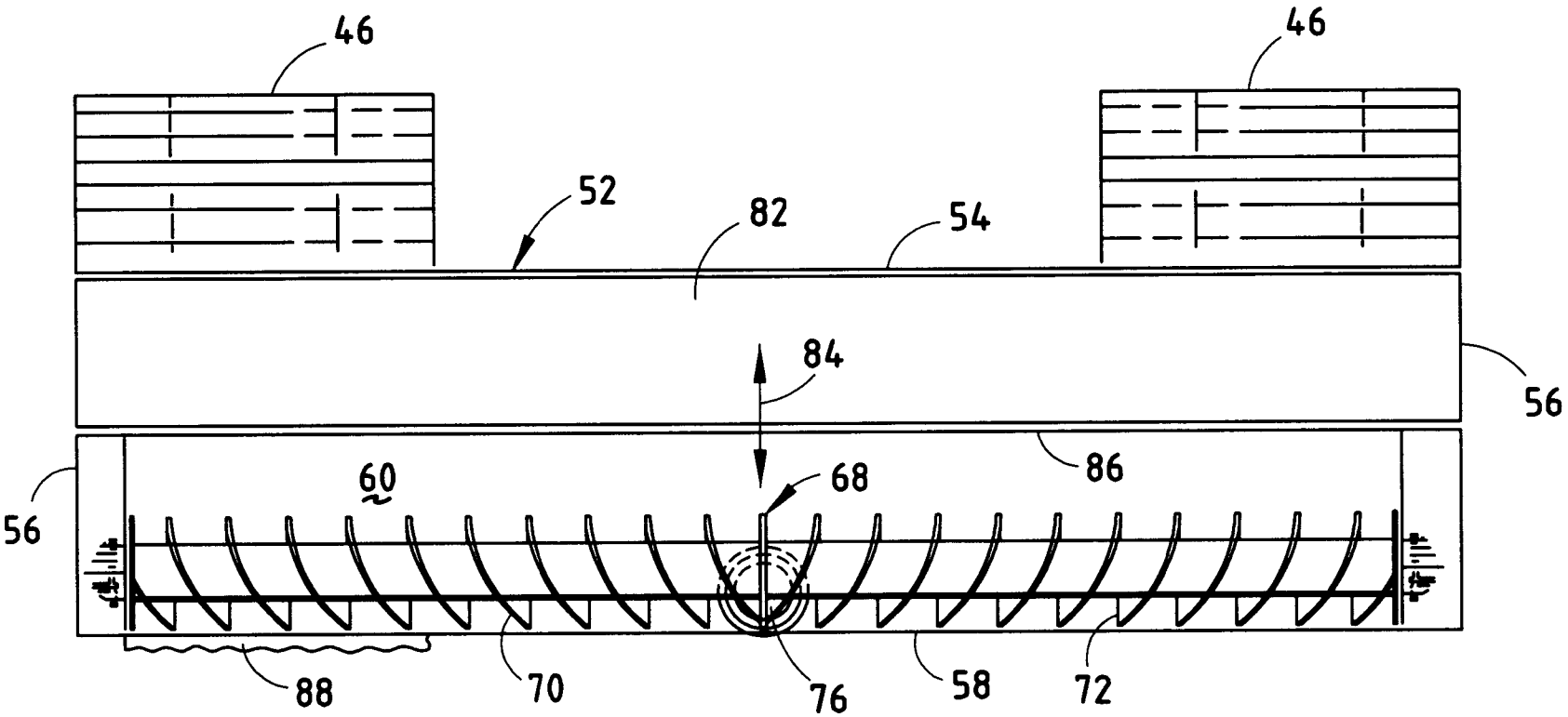
FIG. 10 is a front elevational view of a hood assembly of the crawler.

The crawler 12 further includes a forwardly located intake hood 52 operably attached to a forward section of frame 40. Intake hood 52 (FIG. 10) includes a top wall 54, sidewalls 56, a bottom wall 58 and a rear wall 59, which cooperate to define a forwardly opening aperture 60. Intake hood 52 is constructed of a non-corrosive material such as stainless steel. Intake hood 52 is rotatably attached to frame 40 at pivot points 62 by way of a pair of pivot arms 64, thereby allowing intake hood 52 to be rotatably adjusted relative to a horizontal plane. In operation, the pivoting aspect of intake hood 52 allows intake hood 52 to be adjusted and more precisely track uneven beds or bottoms of bodies of waters, which are typically encountered near the edges of holding ponds associated with water processing plants, and within natural streams. A pair of hydraulic cylinders 66 are pivotally attached to frame 40 and pivot arms 64, thereby allowing the operator to hydraulically control the angle of intake hood 52 with respect to frame 40 of crawler 12.

Intake hood 52 further includes an auger system 68 that includes a hydraulically driven first auger 70 and a hydraulically driven second auger 72. First auger 70 and second auger 72 are counter-rotating, and are adapted to dislodge sediment from the bottom of the body of water and also to force the dislodged sediment into intake hood 52.

A hydraulically powered centrifugal water pump 74 is in fluid communication with intake hood 52 by way of an aperture 76 located within rear wall 59 of intake hood 52. Water pump 74 is driven by a hydraulic motor 75. As illustrated, water pump 74 is capable of about 1500 gallons per minute pumping capacity, however, a larger or smaller pump may be employed depending on the requirements of the application. Water pump 74 is provided with a four inch intake and approximately a five inch discharge, however, the dimensions of the pump may also be altered depending on the particulars of the specific application. Water pump 74 is in fluid communication with an outlet pipe 78. Outlet pipe 78 is in fluid communication with an outlet hose 80, which is in turn connected with a reservoir or tank adapted to receive the sediment and wastewater removed from the associated body of water. A second water pump 81 may be located on barge 10 to assist in moving the removed sediment from the barge 10 to the reservoir or collection tank.

The placement of water pump 74 in close proximity to intake hood 52 provides an increase head pressure, or the pressure generated at aperture 60, than that of systems which locate any associated pumping apparatus with an associated floating device or with an "onshore" component. The increase in head pressure as provided by the present inventive sediment removal system will also remain relatively constant even as the depth of the associated body of water increases. Locating water pump 74 in close proximity to intake hood 52 further ensures that no pressure loss due to leaks in connecting hoses, as employed in other systems, will occur. Further, as a result of water pump 74 being directly controlled by the operation of hydraulic pump 34, the operator can control the flow rate through water pump 74 via a controller 83, and minimize the amount of waste water being removed with the associated sediment. More specifically, as the crawler 12 encounters a decreasing amount of sediment as it moves along the floor of the body of water, the volume of the mixture being removed by the water pump 74 can be reduced by decreasing the power being supplied by the hydraulic motor and thus the water pump, thereby decreasing the amount of overall water being removed from the associated body of water. The volume of the mixture being removed by water pump 74 is infinitely adjustable between the maximum and minimum running speeds of hydraulic pump 34, which allows for fine tuning for the specific application.

Intake hood 52 further includes a gate 82 operably attached to intake hood 52 and movable along a vertical path 84 between an open position wherein aperture 60 is completely open and a closed position wherein gate 82 covers aperture 60. Gate 82 is hydraulically operated by the operator via controller 83, and allows the operator to adjust the amount of sediment/water entering intake hood 52 through aperture 60, and in turn being pumped by water pump 74. Gate 82 defines a lower edge 86. In operation, the operator would ideally attempt to guide lower edge 86 along the uppermost edge of the sediment layer be removed, thereby reducing the amount of water entering intake hood 52 along with the sediment.

The intake hood 52 is further provided with a serrated knife 88 attached to it and extending from bottom wall 58 of intake hood 52. Serrated knife 88 is designed to remove weeds from the bottom of the associated body of water.

Other possible options that may be incorporated into the present inventive sediment removal system including barge 10 and crawler 12 includes a remote control system for guiding crawler 12 along the floor of the associated body of water. The addition of a remote control system would allow the operator to maneuver the crawler 12 along the floor of the associated body of water, and thus barge 10, while remaining at an on-shore location. Another possible option is the addition of a laser targeting system 90 (FIG. 1) and/or the addition of a GPS or global positioning system, thereby allowing highly precise maneuvering of the crawler 12 along the floor of the associated body of water without necessitating visual reference to static landmarks.

Another option is the inclusion of an underwater camera or infrared sensors, thereby allowing the operator to detect obstacles lying in front of the path of travel of crawler 12 before crawler 12 collides with such obstacles.

Still yet another option is the inclusion of a pump flow regulator or density meter 92 within water pump 74, outlet pipe 78 or outlet hose 80, for monitoring the density and/or viscosity of the mixture being removed from the associated body of water, thereby allowing the operator to fine tune the adjustments associated with intake hood 52, as discussed above, to limit the amount of water being removed with the sediment.

Still another option is directing the mixture being removed from the body of water through a clear portion of pipe or conduit 94 (FIG. 1) located proximate the operator, thereby allowing the operator to visually inspect the flow of sediment being removed from the body of water, and adjust the flow rates associated with the intake hood 52 and water pump 74.

The present inventive sediment removal system provides a high pumping pressure regardless of the depth of operation, highly precise maneuverability and navigation, and precise control of pumping rates and characteristics.

In the foregoing description, it will be readily appreciated by those skilled in the art that modifications may be made to the invention without departing from the concepts disclosed herein.

The claimed invention is:

1. A sediment removal system, comprising:

a vessel adapted to float on a surface of a body of water;

a crawler adapted to be submerged in the body of water, the crawler including a drive system for moving the crawler across a bottom of the body of water, the crawler including a suctioning device that supplies a suctioning force that is utilized to remove sediments resting on the bottom of the body of water;

a sediment removal line in communication with the suctioning device and adapted to carry the sediment from the suctioning device away from the crawler;

least one support line extending downwardly from the vessel to the crawler thereby tethering the crawler from the vessel; and at least one tensioning device in mechanical communication with the support line, wherein the tensioning device maintains a tensioning force in the support line at all times, thereby removing any slack within the support line between the vessel and the crawler and requiring the vessel to track substantially close on the surface of the body of water with the crawler as the crawler tracks along the bottom of the body of water.

2. The sediment removal system of claim 1, wherein the at least one support line includes at least one forward support line located proximate a front section of the vessel, and at least one rearward support line located proximate a rear section of the vessel.

3. The sediment removal system of claim 1, wherein the at least one support line includes a pair of forward support lines located proximate a front section of the vessel and juxtaposed laterally across the vessel.

4. The sediment removal system of claim 1, wherein the at least one support line includes a hydraulic line.

5. The sediment removal system of claim 1, wherein the suctioning device is a submersible water pump that is submersed with the crawler.

6. The sediment removal system of claim 5, wherein the crawler includes a submersible hydraulic motor that provides power to the water pump.

7. The sediment removal system of claim 6, wherein the vessel includes a hydraulic pump, and wherein the at least one support line includes a hydraulic line that provides hydraulic power from the hydraulic pump to the hydraulic motor.

8. The sediment removal system of claim 1, wherein the drive system includes a pair of track members located on opposite sides of the crawler.

9. The sediment removal system of claim 8, wherein the drive system includes a pair of drive wheels in mechanical communication with the track members, and wherein the drive wheels drive the tracks in a forward and rearward direction.

10. The sediment removal system of claim 9, wherein the drive system includes a pair of hydraulic motors in mechanical communication with the drive wheels and that drive the drive wheel in clockwise and counterclockwise direction.

11. The sediment removal system of claim 10, wherein the vessel includes a hydraulic pump, and wherein the at least one support line includes a pair of hydraulic lines that provide hydraulic power from the hydraulic pump to the hydraulic motors of the drive system.

12. The sediment removal system of claim 8, wherein the pair of track members can simultaneous operate in opposite direction, thereby providing a small turning radius for the crawler on the bottom of the body of water.

13. The sediment removal system of claim 1, wherein the crawler includes an intake hood having a forwardly opening intake aperture positioned to allow intake of the sediment as the crawler moves in forward direction across the bottom of the body of water.

14. The sediment removal system of claim 13, wherein the suctioning device is a submersible water pump that is submersed with the crawler, and wherein the water pump is in fluid communication with the intake hood such that suctioning force generated by the pump is substantially the same as the suctioning force generated at the intake aperture.

15. The sediment removal system of claim 14, wherein the crawler includes a frame and the intake hood may be rotated with respect the frame, thereby allowing the intake hood to closely track along the bottom surface of the body of water as the bottom surface changes.

16. The sediment removal system of claim 15, wherein the crawler is rotated with respect to the frame via at least one hydraulic cylinder.

17. The sediment removal system of claim 16, wherein the vessel includes a hydraulic pump, and wherein the hydraulic cylinder is in hydraulic communication with the hydraulic pump.

18. The sediment removal system of claim 13, wherein the intake hood includes an adjustable gate that adjusts the size of the intake aperture of the intake hood.

19. The sediment removal system of claim 18, wherein the gate is substantially vertically oriented and operates in a substantially horizontal path when the bottom of the body of water is substantially flat.

20. The sediment removal system of claim 19, wherein adjustment of the gate adjusts a flow rate through the intake hood.

21. The sediment removal system of claim 1, further including:

a density flow meter that measures the viscosity of the sediment through the sediment removal line, thereby allowing an operator to adjust a flow rate of sediment through the sediment removal line.

22. The sediment removal system of claim 1, further including:

a density flow meter that measures the viscosity of the sediment through the sediment removal line thereby providing density measurements, and wherein the density measurements are utilized to automatically control the flow rate of the sediment through the sediment removal system without the input of an operator.

23. The sediment removal system of claim 1, wherein the sediment removal line includes a substantially transparent portion, thereby allow an operator to view the sediment removed from the bottom of the body of water and adjust the flow rate to optimize a sediment to water ratio.

24. The sediment removal system of claim 1, wherein the vessel includes a pair of pontoon-type floats juxtaposed across the vessel.

* * * * *

UNITED STATES PATENT AND TRADEMARK OFFICE

CERTIFICATE OF CORRECTION

PATENT NO. : 6,550,162 B2
DATED : April 22, 2003
INVENTOR(S) : Robert E. Price et al.

It is certified that error appears in the above-identified patent and that said Letters Patent is hereby corrected as shown below:

Column 6,
Line 1, before "least" insert -- at --.

Signed and Sealed this

Nineteenth Day of August, 2003

JAMES E. ROGAN
*Director of the United States Patent and Trademark Office*